US008961150B2

(12) United States Patent
Yang et al.

(10) Patent No.: US 8,961,150 B2
(45) Date of Patent: Feb. 24, 2015

(54) AIR EXCHANGE FAN AND CIRCUIT BOARD BOX THEREFOR

(75) Inventors: Jingtao Yang, Guangdong (CN); Qianhao Tan, Guangdong (CN); Yannong Wu, Guangdong (CN); Pingting Yang, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 393 days.

(21) Appl. No.: 13/285,270

(22) Filed: Oct. 31, 2011

(65) Prior Publication Data

US 2012/0107096 A1 May 3, 2012

(30) Foreign Application Priority Data

Nov. 2, 2010 (CN) ..... 2010 1 0532484
Nov. 2, 2010 (CN) ..... 2010 2 0599215 U

(51) Int. Cl.
*F04B 39/00* (2006.01)
*F04D 29/42* (2006.01)
*F04D 25/06* (2006.01)

(52) U.S. Cl.
CPC ..... *F04D 29/4213* (2013.01); *F04D 25/0693* (2013.01)
USPC ..... 417/312; 417/423.14

(58) Field of Classification Search
CPC ..... F04D 17/06; F04D 29/54–29/548
USPC ..... 417/423.1–423.14, 424.1, 424.2, 312; 415/51, 119, 183–185, 203–206, 415/208.1–208.5, 211.1, 213.1, 214.1, 415/214.4, 215.1; 181/198.202, 205; 360/98.07, 99.04, 99.08, 99.09, 99.11; 454/251–253, 275–283, 309, 329
See application file for complete search history.

(56) References Cited

U.S. PATENT DOCUMENTS

| | | | | |
|---|---|---|---|---|
| 3,796,511 | A * | 3/1974 | Hansen | 415/144 |
| 5,842,840 | A * | 12/1998 | Korek et al. | 417/423.14 |
| 5,997,246 | A * | 12/1999 | Humbad | 415/119 |
| 7,014,422 | B2 * | 3/2006 | Hancock | 415/204 |
| 7,909,571 | B2 * | 3/2011 | Wu et al. | 415/206 |
| 2010/0186932 | A1 * | 7/2010 | Chou | 165/104.34 |

* cited by examiner

*Primary Examiner* — Peter J Bertheaud
*Assistant Examiner* — Dnyanesh Kasture
(74) *Attorney, Agent, or Firm* — RatnerPrestia

(57) ABSTRACT

An air exchange fan, includes: a frame provided with an opening, a helicoid housing with an air suction inlet disposed in the frame, an air blower disposed in the helicoid housing, and, a circuit board box mounted at the air suction inlet side, wherein a silencing plate is mounted above the outer peripheral of the air suction inlet, the silencing plate has a streamlining structure formed by outwardly expanding from the air suction inlet in an axial direction of a rotation axis of the air blower, the rotation axis of which serving as the center, within a range that is from a tongue of the helicoid housing to a location with a 90 degrees angled from the tongue in a direction opposing to the rotation direction of the air blower, and the silencing plate has a curved chamfered shape which mates with the peripheral shape of the air suction inlet.

10 Claims, 9 Drawing Sheets

AIR EXCHANGE FAN AND CIRCUIT BOARD BOX THEREFOR

FIELD OF THE INVENTION

The present invention relates to an air exchange fan and a circuit board box for the air exchange fan.

DESCRIPTION OF THE RELATED ART

As shown in FIG. 1, a conventional air exchange fan 100 is provided. The air exchange fan 100 comprises a frame 110 provided with an opening 111, a helicoid housing 130 with an air suction inlet 120 disposed in the frame 110, an air blower 131 disposed in the helicoid housing 130, and an elongated circuit board box 140 mounted at the air suction inlet side of the helicoid housing 130 of the air exchange fan. The circuit board box 140 is provided with an opening 144 for passing a leading wire 143 therethrough.

Because the elongated circuit board box 140 is located at the air suction inlet 120 side of the helicoid housing 130 of the air exchange fan and occupies a relatively large space, the smooth airflow at the air suction inlet may be disturbed by the elongated circuit board box 140, so that the level of noise is difficult to reach a desired state.

In the air exchange fan 100 in the prior art, the opening 144 for passing the leading wire 143 therethrough is provided on the circuit board box 140, while, the leading wire 143 is provided from the bottom up, that is, the leading wire 143 is extended out of the opening 144 and then is introduced into a junction box 30 positioned over the opening 144, in the circuit board box 140.

Accordingly, once water vapor comes into the air exchange fan 100 when the air exchange fan is operated, the water vapor adheres onto the leading wire 143 and finally gathers into water drop that would flow downwardly along the leading wire 143 into the opening 144 of the circuit board box 140 at the inferior location. Since there is no waterproof structure at the opening 144 of the circuit board box 140, the water drop may enter into the circuit board box 140 finally so as to damage the circuit board.

In addition, in order to prevent the leading wire 143 from being outwardly stretched out, a clip (not shown in the Fig.) for holding the leading wire 143 is provided at the inside of the circuit board box 140. However, there is a possibility that the leading wire 143 may be fell off from the circuit board when it is being inwardly extruded. In order to solve this problem, an additional clip (not shown in the Fig.) for the leading wire is generally provided at the outside. However, this solution results in increase of the cost as well as the additional working hour on the mounting of the clip.

SUMMARY OF THE INVENTION

The present invention has been made to overcome or alleviate at least one of the above-mentioned problems and drawbacks existing in the prior art.

Accordingly, it is at least an object of the present invention to provide an air exchange fan, which has a low noise level during the operation.

Accordingly, it is another object of the present invention to provide a circuit board box for an air exchange fan, which has well safety.

In order to achieve at least one of the above-mentioned objects, the present invention provides an air exchange fan. An air exchange fan, comprises: a frame provided with an opening, a helicoid housing with an air suction inlet disposed in the frame, an air blower disposed in the helicoid housing, and, a circuit board box mounted at the air suction inlet side of the helicoid housing of the air exchange fan, wherein, a silencing plate is mounted above the outer peripheral of the air suction inlet of the helicoid housing of the air exchange fan, the silencing plate has a streamlining structure formed by outwardly expanding from the air suction inlet in an axial direction of a rotation axis of the air blower, the rotation axis of which being served as the center, within a range that is from a tongue of the helicoid housing to a location with a 90 degrees angled from the tongue in a direction opposing to the rotation direction of the air blower, and the silencing plate has a curved chamfered shape which mates with the peripheral shape of the air suction inlet.

In one aspect, the circuit board box is mounted on the helicoid housing of the air exchange fan, between the silencing plate and the frame, and, is integrated with the silencing plate.

In one aspect, the silencing plate has a first curved chamfered shape plate with the curvature as the same as that of the peripheral of the air suction inlet, and a second curved chamfered shape plate paralleled with an outer peripheral side of the first curved chamfered shape plate; wherein a sound-absorption groove is formed between the first and second curved chamfered shape plates.

Further, the first curved chamfered shape plate is formed by downwardly bending one side of an upper box part of the circuit board box located at the air suction inlet side of the helicoid housing, with the curvature as the same as that of the peripheral of the air suction inlet; the second curved chamfered shape plate is embodied as a wall, away from the air suction inlet side, of a lower box part of the circuit board box; and, the first curved chamfered shape plate is paralleled with the second curved chamfered shape plate, an elongated hollow groove, i.e., the sound-absorption groove, is formed between the first and second curved chamfered shape plates, and, the sound-absorption groove is disposed over and is paralleled with the air suction inlet of the helicoid housing.

Furthermore, the lower end of the first curved chamfered shape plate is located in a location which is higher than that of the lower end of the second curved chamfered shape plate, to form an opening being intercommunicated to the sound-absorption groove.

In one aspect, the sound-absorption groove is provided with a concavo-convex structure on the inner wall thereof.

As apparent form the above, the air exchange fan according to the present invention at least has the following advantages and benefits: to achieve an excellent noise reduction effect by means of providing a silencing plate with streamlining structure at a high static pressure region that is from a tongue of the helicoid housing to a location with a 90 degrees angled from the tongue in a direction opposing to the rotation direction of the air blower; and, to eliminate the hindrance of the air flow in the air suction inlet, by providing the circuit board box at the outside of the silencing plate, that is, by changing the location of the circuit board box in the conventional solution, so as to achieve a further noise reduction effect.

Meanwhile, the present invention also provides a circuit board box for an air exchange fan. A circuit board box for an air exchange fan, comprises a lower box part and an upper box part, wherein, the circuit board box is provided with a hollow projection having a through opening in the longitudinal direction thereof and an opening for passing a leading wire therethrough in the transverse direction.

In one aspect, the hollow projection is formed by engaging a first projection part with a first semicircular recess provided at the lower box part while a second projection part with a second semicircular recess provided at the upper box part.

In one aspect, the leading wire is provided with a leading wire clip positioned in the through opening.

As apparent form the above, the circuit board box for the air exchange fan according to the present invention at least has the following advantages and benefits: to prevent the water drop from entering into the circuit board box, and, to prevent the leading wire from being outwardly stretched out of or being inwardly extruded into the circuit board box by only employing one clip for the leading wire.

BRIEF DESCRIPTION OF THE DRAWINGS

The present invention may be understood and its features made apparent to those skilled in the art by referencing the accompanying drawings.

DETAILED DESCRIPTION OF PREFERRED EMBODIMENTS OF THE INVENTION

In the following description, numerous specific details are set forth to provide a more thorough description of the present invention. It will be apparent, however, to one skilled in the art, that the present invention may be practiced without these specific details. In other instances, well-known features have not been described in detail so as not to obscure the invention.

Figure 1:
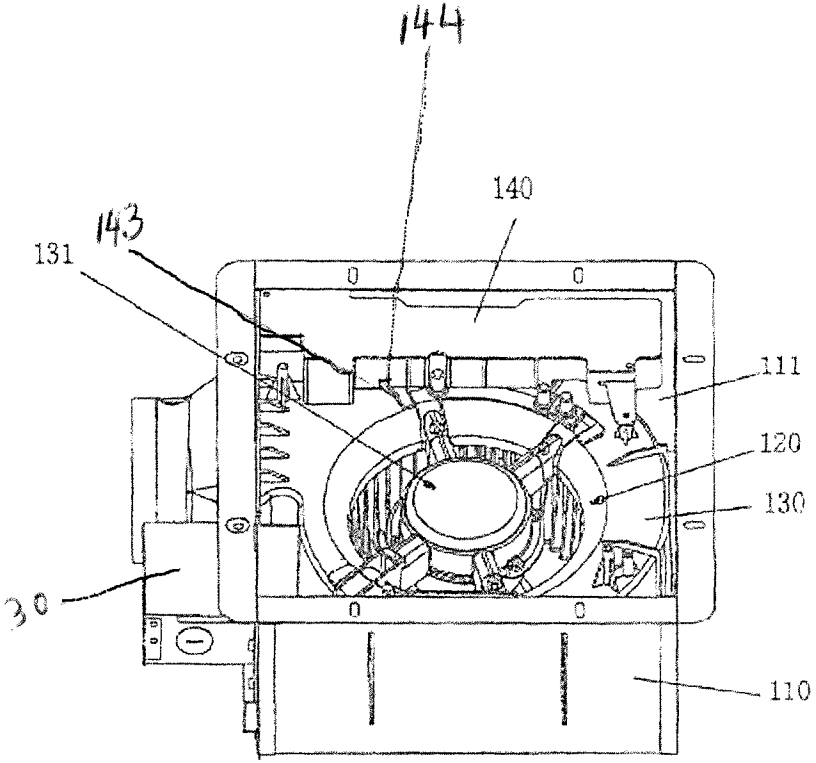
Fig. 1 PRIOR ART
FIG. 1 is a schematic view of an air exchange fan in the prior art.
Figure 2A:
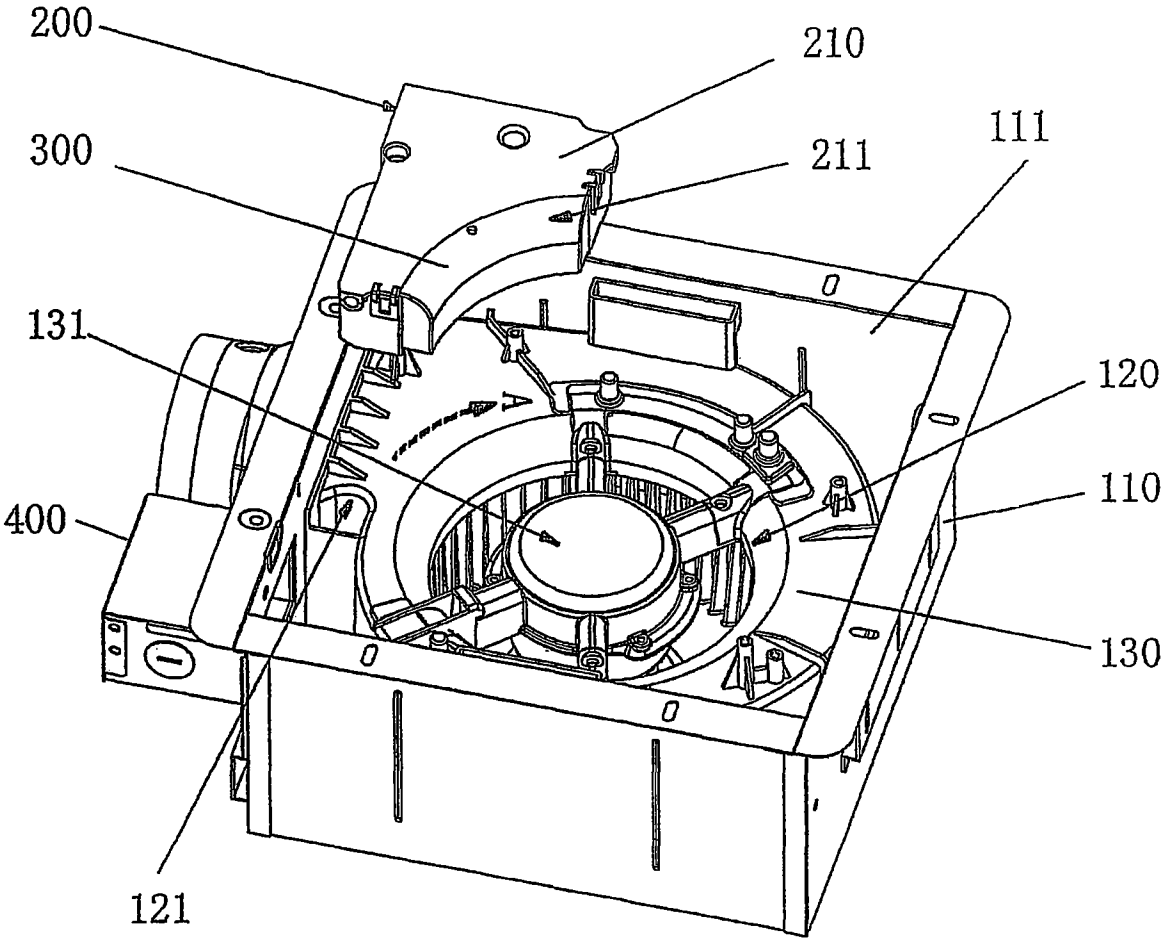
FIG. 2A is a schematic view of the air exchange fan according to a first embodiment of the present invention.
Figure 2B:
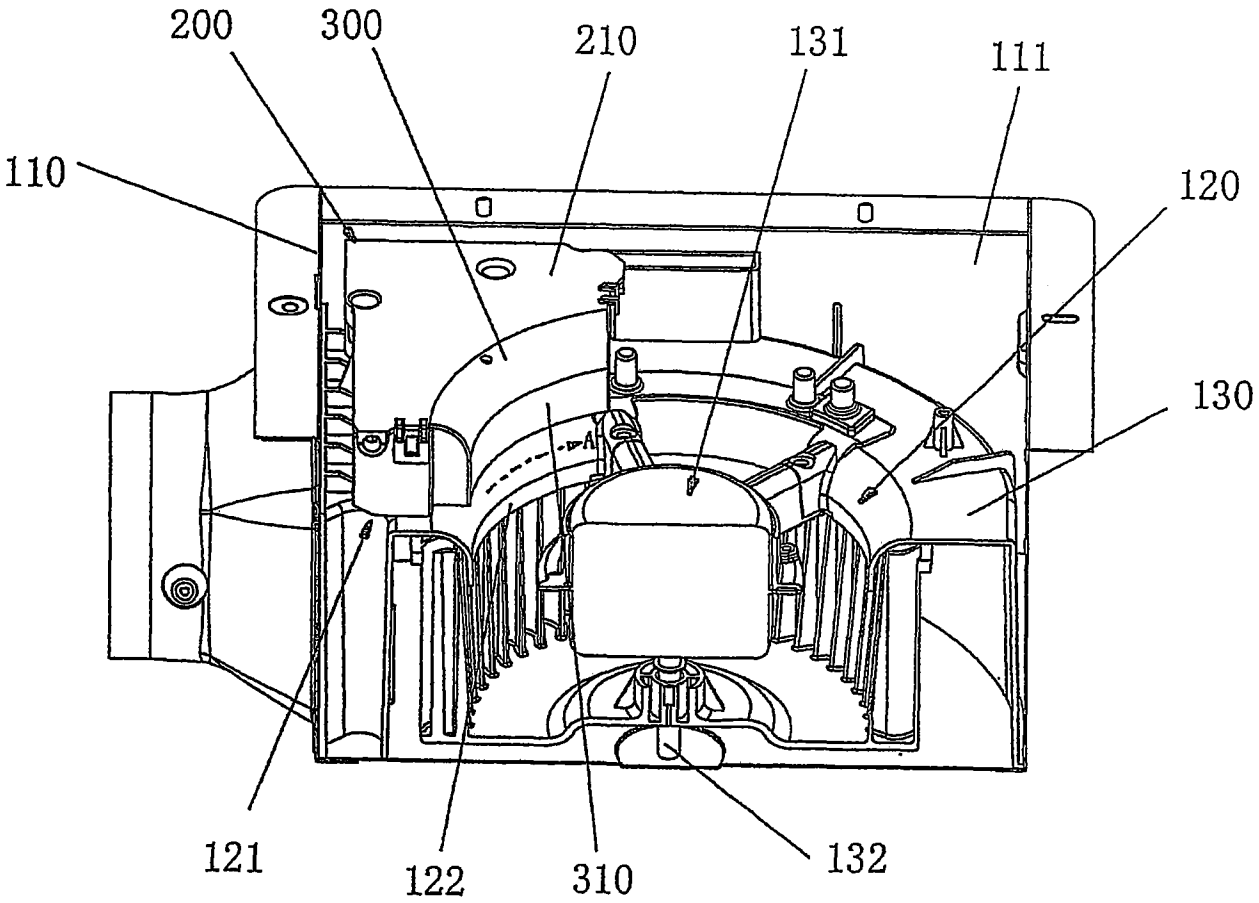
FIG. 2B is a sectional schematic view of the air exchange fan according to the first embodiment of the present invention.

FIG. 2A is a schematic view of the air exchange fan according to a first embodiment of the present invention. FIG. 2B is a sectional schematic view of the air exchange fan according to the first embodiment of the present invention. As shown in FIG. 2A, an air exchange fan 100, comprises: a frame 110 provided with an opening 111, and, a helicoid housing 130 with an air suction inlet 120 disposed in the frame 110, an air blower 131 disposed in the helicoid housing 130. The circuit board box 200 is mounted above the outer peripheral of the air suction inlet 120 of the helicoid housing 130 of the air exchange fan, within a range that is from a tongue 121 of the helicoid housing 130 to a location with a 90 degrees angled from the tongue 121 in a direction (that is, the clockwise direction of the arrow A shown in FIGS. 2A and 2B) opposing to the rotation direction of the air blower 131. The circuit board box 200 is located on a side 211 of an upper box part 210 at the air suction inlet side of the helicoid housing, and, a silencing plate 300 is formed by outwardly expanding from the air suction inlet and has a curved chamfered shape which mates with the peripheral shape of the air suction inlet. As shown in FIG. 2B, the silencing plate 300 has a streamlining structure formed by outwardly expanding from the air suction inlet in an axial direction of a rotation axis 132 of the air blower 131, the rotation axis of which being served as the center. The above-mentioned streamlining structure means that the air flow sucked into the air suction inlet 120 of the helicoid housing may flows in a much smoother manner. The upper box part 210 of the circuit board box 200 at the air suction inlet 120 side of the helicoid housing 130 is bent with the curvature as the same as that of the peripheral of the air suction inlet. In other words, the circuit board box 200 is mounted on the helicoid housing 130 of the air exchange fan, between the silencing plate 300 and the frame 110, and, is integrated with the silencing plate 300.

Again, as shown in FIG. 2B, the outer wall 310 of the silencing plate 300 and the outer peripheral 122 of the air suction inlet 120 of the helicoid housing 130 are the same vertical one. The curvature of the silencing plate 300 is as the same as that of the outer peripheral 122 of the air suction inlet 120. An imaginary extension line from the outer wall 310 of the silencing plate 300 will be overlapped with that of the outer peripheral 122 of the air suction inlet 120.

Again, as shown in FIGS. 2A and 2B, by adopting the above-mentioned structure, the airflow resistance is reduced because the silencing plate 300 has a streamlining structure which mates with the configuration of the air suction inlet 120 of the helicoid housing 130. The airflow smoothly enters into the air suction inlet 120, so as to reduce the noise. In addition, considering there is an extremely great noise at the tongue 121 of the helicoid housing 130 due to the narrow and small tongue 121 at the air suction inlet 120 of the helicoid housing 130 and the high static pressure, the streamlining structure silencing plate 300 is located in the high static pressure region (i.e., within a range that is from the tongue 121 of said helicoid housing 130 to a location with a 90 degrees angled from the tongue 121 in a direction opposing to the rotation direction of said air blower 131, with the rotation axis of said air blower being served as the center), so as to achieve a better noise reduction effect. Further, the silencing plate 300 is covered by the circuit board box 200, so the noise is further reduced. The circuit board box 200 is integrated with the silencing plate 300, and both of them are located in the high static pressure region. Since the high static pressure region is very close to the junction box 400, it is convenient for the connection between the leading wire of the circuit board box 200 and the wire from the junction box 400.

Figure 3:
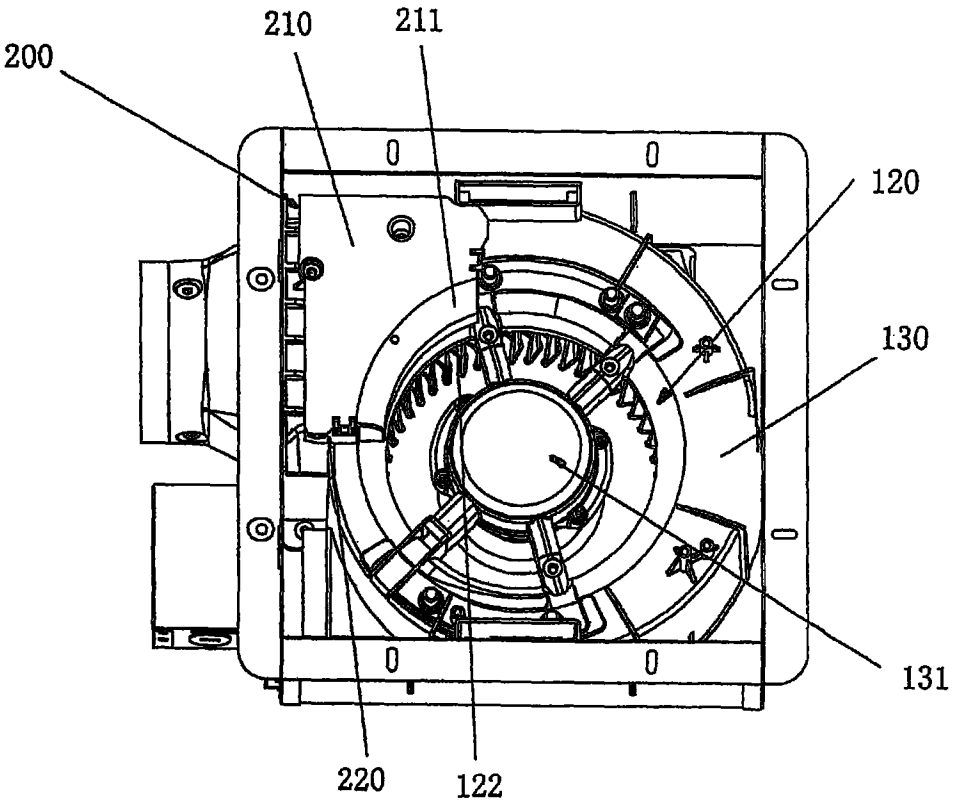
FIG. 3 is a schematic view of the air exchange fan according to a second embodiment of the present invention.
Figure 4:
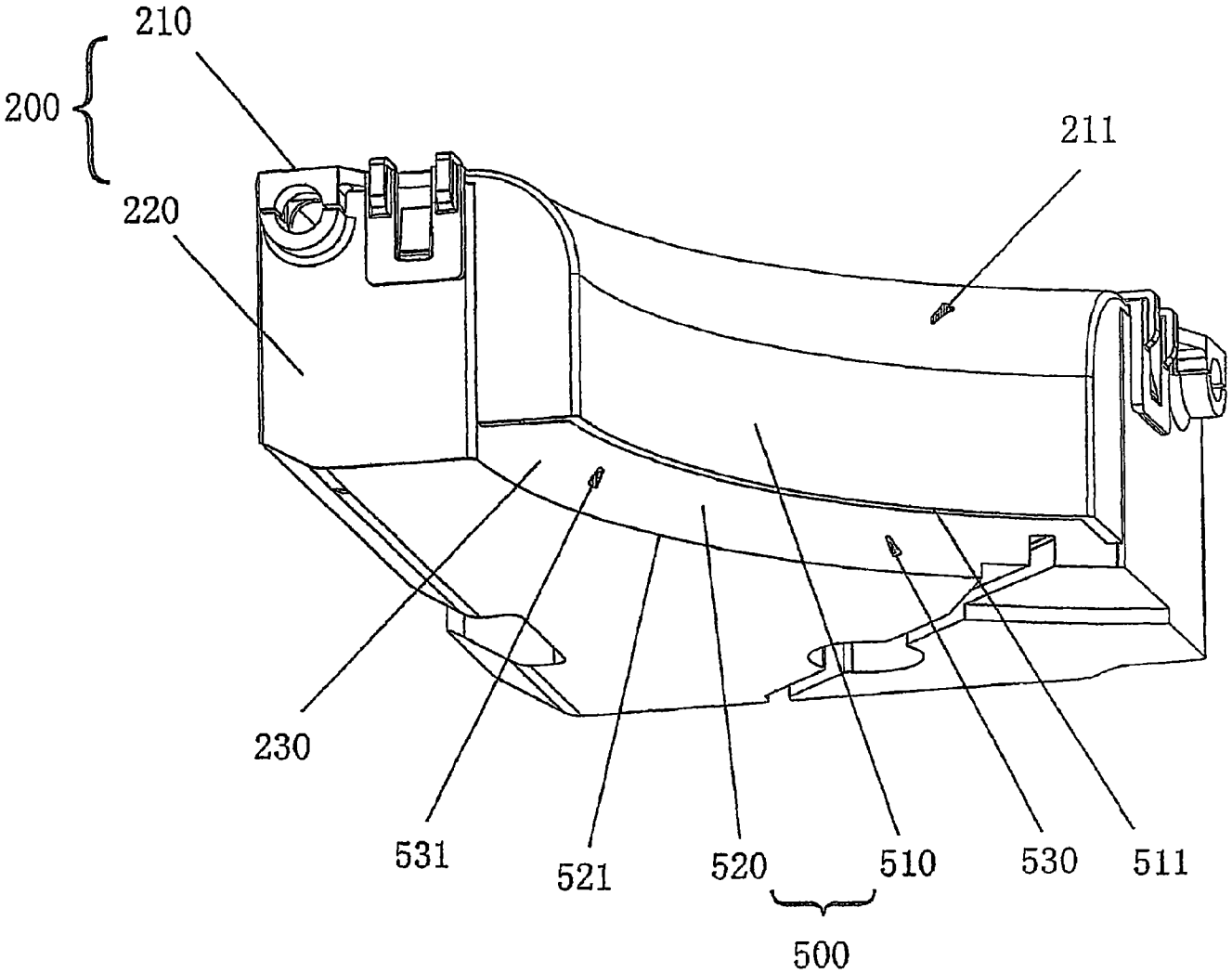
FIG. 4 is a schematic view of a circuit board box integrated with a silencing plate according to the second embodiment of the present invention.
Figure 5:
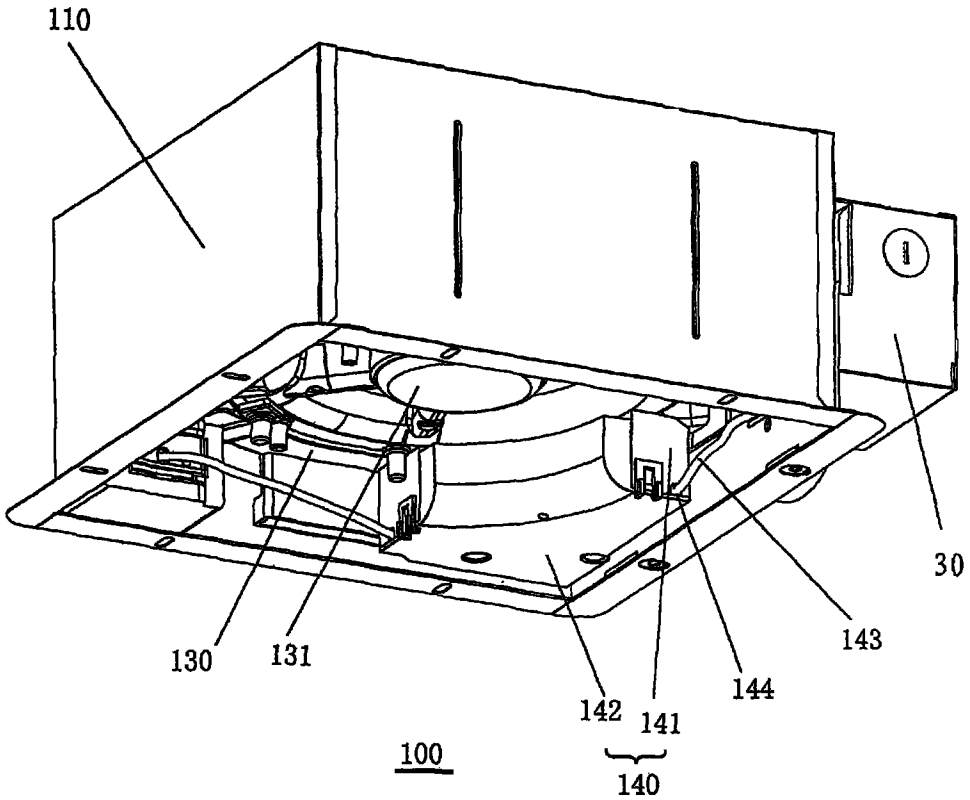
FIG. 5 is a schematic view of a circuit board box for an air exchange fan.

FIG. 3 is a schematic view of the air exchange fan according to a second embodiment of the present invention. FIG. 4 is a schematic view of a circuit board box integrated with a silencing plate according to the second embodiment of the present invention. As shown in FIG. 3 and FIG. 4, the silencing plate 500 according to the present embodiment has a first curved chamfered shape plate 510 with the curvature as the same as that of the peripheral 122 of the air suction inlet 120, and a second curved chamfered shape plate 520 paralleled with an outer peripheral side of the first curved chamfered shape plate 510; and, a sound-absorption groove 530 is formed between the first and second curved chamfered shape plates 510, 520. Further, The first curved chamfered shape plate 510 is formed by downwardly bending one side 211 of an upper box part 210 of the circuit board box 200 located at the air suction inlet 120 side of the helicoid housing 130, with the curvature as the same as that of the peripheral of the air suction inlet; and, the second curved chamfered shape plate 520 is embodied as a wall 230, away from the air suction inlet 120 side in the radial direction, of a lower box part 220 of the circuit board box 200. The first curved chamfered shape plate 510 is paralleled with the second curved chamfered shape plate 520, an elongated hollow groove, i.e., the sound-absorption groove 530, is formed between the first and second curved chamfered shape plates 510, 520, and, the sound-absorption groove 530 is disposed over and is paralleled with the air suction inlet 120. Furthermore, the lower end 511 of the first curved chamfered shape plate 510 is located in a location which is higher than that of the lower end 521 of the second curved chamfered shape plate 520, to form an opening 531 being intercommunicated to the sound-absorption groove 530. In addition, the sound-absorption groove 530 is provided with a plurality of concavo-convex structures on the inner wall (no shown in the Fig.) thereof.

Again, as shown in FIG. 3 and FIG. 4, when the air exchange fan 100 is operated, the noise generated by the fan 131 is sent off and is diffused at the air suction inlet 120 of the helicoid housing 130, especially, at the high static pressure region of the air suction inlet 120. The silencing plate 500 provided with the sound-absorption groove 530 is disposed at the high static pressure region of the air suction inlet 120. Once the noise is generated at the high static pressure region of the air suction inlet 120, the sound waves of the noise are sent into the sound-absorption groove 530 of the silencing plate 500 from the intercommunicated opening 531, and then, are repeatedly collided in the sound-absorption groove 530, during which energy goes weak and the sound pressure reduces. Especially, due to the concavo-convex structures (not shown in the Figs.) provided on the inner wall of the sound-absorption groove 530, once the sound waves of the noise are sent into the sound-absorption groove 530 and then are repeatedly collided with the concavo-convex structures (not shown in the Figs.), energy of the sound waves goes weak gradually so as to further reduce the noise.

Figure 6A:
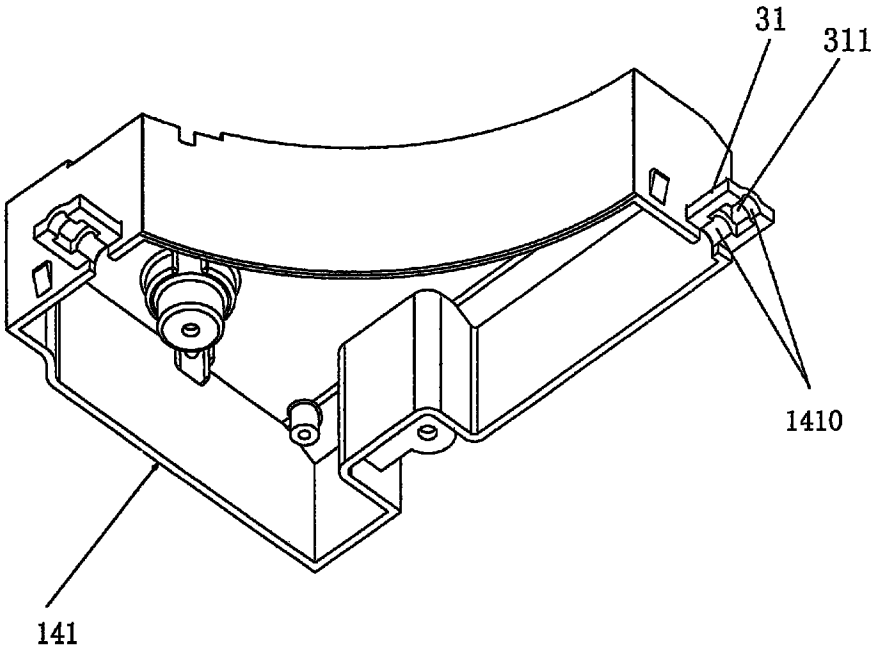
FIG. 6A is a schematic view of a lower box part of the circuit board box according to another embodiment of the present invention.
Figure 6B:
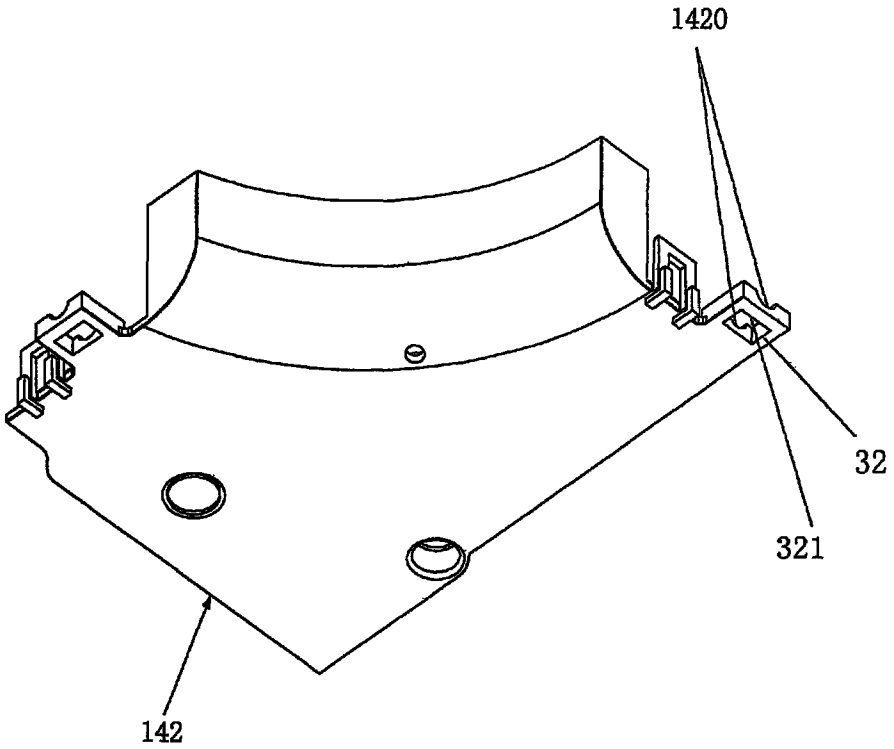
FIG. 6B is a schematic view of an upper box part of the circuit board box according to the above-mentioned another embodiment of the present invention.

As shown in FIG. 6A and FIG. 6B, the schematic views of the lower box part and the upper box part of the circuit board box according to another embodiment of the present invention are illustrated. These Figures only emphasize on the projection, and the rest in these figures are as the same as that in the prior art.

A circuit board box 140 for an air exchange fan 100, comprises a lower box part 141 and an upper box part 142. A first projection part 31 with a first semicircular recess 1410 is provided at said lower box part 141 while a second projection part 32 with a second semicircular recess 1420 is provided at said upper box part 142. The first projection part 31 has a through opening 311 and the second projection part 32 has an opening 321.

Figure 7:
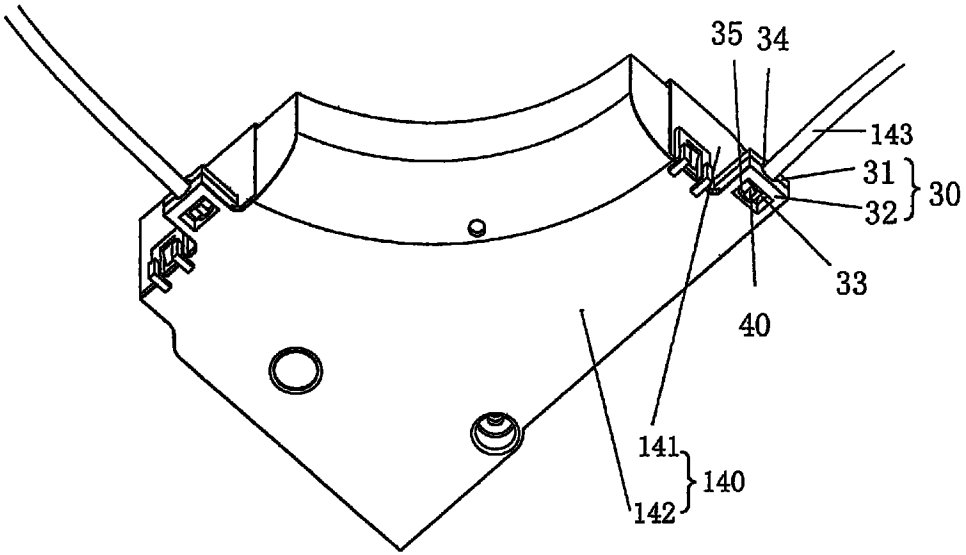
FIG. 7 is a schematic view of the assembled circuit board box according to the above-mentioned another embodiment of the present invention.

FIG. 7 shows a schematic view of the assembled circuit board box according to the above-mentioned another embodiment of the present invention. Once the lower box part 141 and the upper box part 142 are engaged, the first and second semicircular recesses 1410, 1420 mates with each other to form a hollow projection 30. The term "hollow" mentioned in the present invention means that it is in a wholly opening rectangular shape when observed in the longitudinal direction. For example, the through opening 33 provided at the hollow projection 30 in the longitudinal direction has a wholly opening rectangular shape when observed in the longitudinal direction.

A first opening 34 for passing a leading wire 143 therethrough is provided in the transverse direction of the hollow projection 30. The first opening 34 is formed by the engagement between the upper and lower box parts 142, 141. Further, a second opening 35 for passing the leading wire 143 through the circuit board box 140 is formed in the same manner. The leading wire 143 enters into the through opening 33 through the first opening 34 and leads into the circuit board box 140 through the second opening 35. A leading wire clip 40 is provided at the through opening 143 and is located in the through opening 33.

As shown in FIG. 6A, FIG. 6B and FIG. 7, the assembly process of the leading wire 143 is illustrated. First of all, to lock the leading wire 143 in the first semicircular recess 1410 of the first projection part 31 provided at said lower box part 141, at the same time, to clamp the leading wire clip 40 into the opening 311 provided at the first projection part 31. Then, to engage the upper box part 142 with the lower box part 141, in which to lock the leading wire 143 in the second semicircular recess 1420 of the second projection part 32 provided at said upper box part 142, at the same time, to clamp the leading wire clip 40 into the opening 321 provided at the second projection part 32. When the upper and lower box parts 142, 141 are engaged, the leading wire 143 is fixed into the first and second openings 34, 35 for the leading wire.

Once water vapor comes into the air exchange fan, the water vapor adheres onto the leading wire 143 and finally gathers into water drop. The water drop then flows downwardly along the leading wire 143 and goes into the first opening 34. The water drop would be obstructed by the hollow projection 30 provided at the first opening 34 but falls down into the ground. Even the water drop goes into the inferior along the leading wire 143, it would goes through the longitudinally through opening 33 provided at the hollow projection 30 and falls down into the ground. Further, the water drop also may be obstructed by the leading wire clip 40, so the water drop would not go into the circuit board box 140, such that a multiple waterproof function is achieved.

In addition, since the leading wire clip 40 is restricted in the through opening 33, the leading wire 143 can not be outwardly stretched out, so as to protect the electrically components on the PCB from being damaged, such that the safety of the product is ensured. That is to say, by the adoption of the hollow projection 30, not only the waterproof function is achieved but also the excessive stretch or extrusion is prevented. According to the present invention, the shape of the hollow projection 30 is not only limited to the schematic square shape shown in the present embodiment, but also involves any structures that there is a hollow in the intermediate, such as a circular shape, etc.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An air exchange fan, comprising: a frame provided with an opening, a helicoid housing with an air suction inlet disposed in the frame, an air blower disposed in the helicoid housing, and, an circuit board box mounted around the air inlet suction on the helicoid housing, it is characterized in that, at the air suction inlet, the circuit board box is mounted within an area which extends from a first location corresponding to a tongue of said helicoid housing to a second location, the second location oriented 90 degrees in a direction contrary to a direction of rotation of said air blower with respect to the first location, a silencing plate is directly positioned over the circuit board box, the silencing plate has a streamlining structure formed by outwardly expanding from said air suction inlet in an axial direction of a rotation axis of said air blower, and the silencing plate has a curved chamfered shape which is aligned with the peripheral shape of said air suction inlet, wherein, when viewed along the rotation axis, said silencing plate has a first edge and a second edge, and a closed angle between the first and second edges substantially overlaps said area which extends from said first location to said second location.

2. The air exchange fan according to claim 1, characterized in that, said circuit board box is mounted on the helicoid housing of the air exchange fan, between said silencing plate and said frame, and, is integrated with said silencing plate.

3. The air exchange fan according to claim 2, characterized in that, said silencing plate has a first curved chamfered shape plate, a curvature of the first curved chamfered shape plate being the same as that of the outer peripheral shape of said air suction inlet, and a second curved chamfered shape plate paralleled with an outer peripheral side of said first curved chamfered shape plate; wherein a sound-absorption groove is formed between said first and second curved chamfered shape plates.

4. The air exchange fan according to claim 3, characterized in that, said first curved chamfered shape plate is formed by downwardly bending one side of an upper box part of said circuit board box located at the air suction inlet side of the helicoid housing, with the curvature being the same as that of the outer peripheral shape of said air suction inlet; said second curved chamfered shape plate is embodied as a wall, away from said air suction inlet side, of a lower box part of said circuit board box; and, said first curved chamfered shape plate is paralleled with said second curved chamfered shape plate, the sound-absorption groove is formed between said first and second curved chamfered shape plates, and the sound-absorption groove is disposed over and is paralleled with said air suction inlet of said helicoid housing.

5. The air exchange fan according to claim 4, characterized in that, a lower end of said first curved chamfered shape plate is located in a location which is higher than that of a lower end of said second curved chamfered shape plate, to form an opening being intercommunicated to the sound-absorption groove.

6. The air exchange fan according to claim 4, characterized in that, said sound-absorption groove is provided with a concavo-convex structure on the inner wall thereof.

7. The air exchange fan according to claim 1, characterized in that, the circuit board box comprises a lower box part and an upper box part, said circuit board box is provided with a hollow projection having a through opening in the longitudinal direction thereof and an opening for passing a leading wire therethrough in the transverse direction.

8. The air exchange fan according to claim 7, characterized in that, said hollow projection is formed by engaging a first projection part with a first semicircular recess provided at said lower box part while a second projection part with a second semicircular recess provided at said upper box part.

9. The air exchange fan according to claim 7, characterized in that, said leading wire is provided with a leading wire clip positioned in said through opening.

10. The air exchange fan according to claim 1, wherein the second location is located with respect to the first location in a direction that is opposite to the rotational direction of the air blower.

* * * * *